United States Patent [19]

Stackhouse et al.

[11] 3,938,640

[45] Feb. 17, 1976

[54] COIN OPERATED LOCK

[75] Inventors: Wells F. Stackhouse, Ashville; Douglas A. Barth, Sinclairville, both of N.Y.

[73] Assignee: American Locker Company, Inc., Jamestown, N.Y.

[22] Filed: Mar. 5, 1975

[21] Appl. No.: 555,701

[52] U.S. Cl. ..... 194/92
[51] Int. Cl.[2] ..... G07F 1/04
[58] Field of Search ..... 194/92, 78

[56] References Cited

UNITED STATES PATENTS 3,228,506 1/1966 Stackhouse ..... 194/92

3,599,770 8/1971 Stackhouse ..... 194/92

*Primary Examiner*—Stanley H. Tollberg
*Attorney, Agent, or Firm*—Bean & Bean

[57] ABSTRACT

In a coin operated lock unit having a coin operated patron key lock adapted to effect locking of a cabinet door, the improvement featuring adjustment of the patron lock to accommodate different coin denominations, as well as varying numbers of coins of each denomination.

2 Claims, 7 Drawing Figures

36
100
102
138a
136a
132a
134a
104a
104
86
90
92
130
121a
82
104b
128
121b
64
127
126
124
125
136b
132b
123
122
134b
138b
68
68'
140a
117
108a
120
142a
144a
67
153
116
108b
115
108a'
153'
62'
106
114
108b'
119
148
148'
106'
60
113
151
152
112
118
111
156
151
155
110
150
140b
144b
142b
154

COIN OPERATED LOCK

BACKGROUND OF THE INVENTION

The present invention relates to an improvement in coin operated locks of the type disclosed in U.S. Pat. Nos. 3,228,506 and 3,599,770, wherein the lock unit includes a coin operated patron lock employed to lock a cabinet door in closed position.

In locks of the type disclosed by the above mentioned patents, a coin intercepting finger is arranged to project into a coin chute or guide for the purpose of releasably intercepting and holding a properly sized coin in position in which it may be sensed by a coin feeling finger insertable into the coin chute when the patron lock is rotated towards a locked position. If the feeling finger does not contact a coin, the patron lock can not be locked. In this type of prior lock construction, the coin intercepting finger may be adjusted in order to accommodate the lock for use with various coin sizes. However, a drawback of these prior lock units is that they are limited in use to a single coin of whatever size or denomination for which the intercepting finger is adjusted.

SUMMARY OF THE INVENTION

The present invention is directed towards an improvement in locks of the type disclosed by U.S. Pat. Nos. 3,228,506 and 3,599,770, whereby the patron lock may be readily adjusted to accommodate for both different coin denominations and varying numbers of coins of each denomination.

The present lock construction features a vertically inclined coin chute or guide in which coins, which are releasably retained within the slot by engagement of a lowermost properly sized coin with an intercepting finger, are caused to rest edge to edge with a next lower coin and against a referenced-support surface, which is formed with a recess or cutout disposed opposite to a coin sensing finger. This arrangement coupled with the proper location of the intercepting finger relative to the coin sensing finger allows coin blockage of the sensing finger only when the proper number and denomination of coins are deposited in the coin chute.

DRAWINGS

The present invention will now be described in detail in the following description taken with the accompanying drawings wherein.

DETAILED DESCRIPTION

Figure 1:
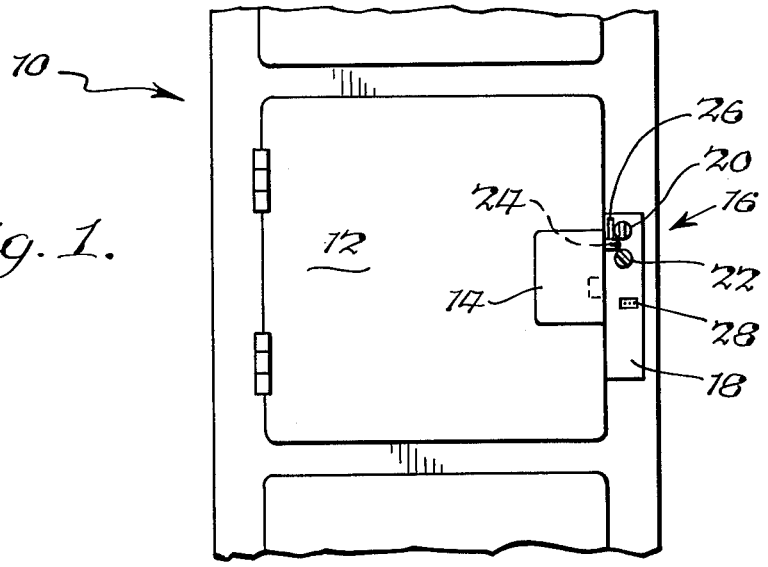
FIG. 1 is a fragmentary front elevational view of a bank of checking lockers employing the present invention.

Now referring particularly to FIG. 1, 10 designates a bank of coin-controlled checking cabinets and 12 indicates a door closure of one of the cabinets on which is fixed a hand gripping block or flange 14 adapted to facilitate opening and closing of the door.

A locking unit 16, which is employed to lock door 12 in closed position, includes a face or front plate 18 through which extends a custodian or control lock 20, a patron lock 22 and a patron lock release rod 24. Face plate 18 is also apertured to define a coin insertion slot 26 and preferably apertured to permit viewing of the numeral wheels of a counter 28.

The various elements forming lock unit 16 may be mounted on face plate 18, so as to permit the lock unit to be removably secured within an opening, not shown, provided in a marginal portion of the cabinet adjacent door 12. To this end, lock unit 16 is preferably secured in place by cooperation of a face plate bottom lip 30 and a lip 32, which is carried by barrel 34 of custodian lock 20. Barrel 34 may be rotated by means of a removable custodian control key, not shown, so as to move lip 32 counter-clockwise from its locking position shown in FIG. 2 in order to enable the whole of the lock unit to be removed from the cabinet.

Figure 2:
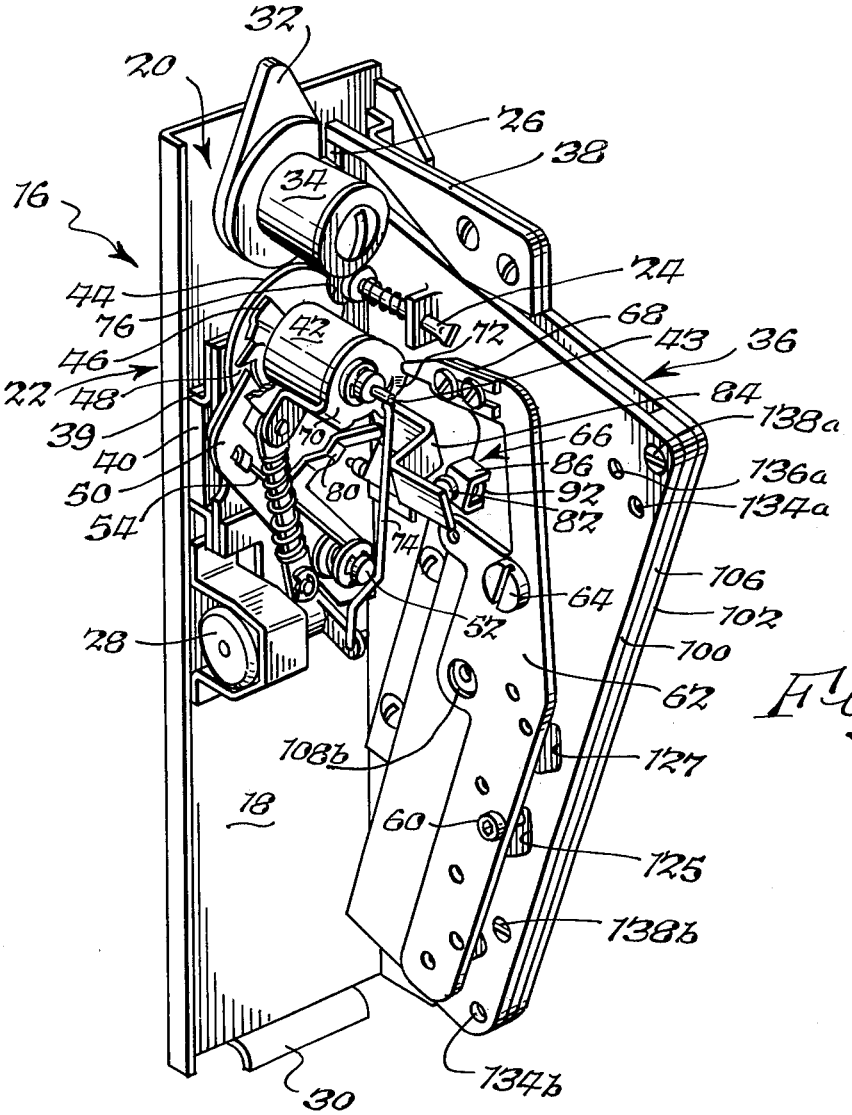
FIG. 2 is a perspective view of the lock unit employing the present invention in a cabinet door unlocked condition.

By referring to FIG. 2, it will be understood that face plate 18 additionally serves to mount a coin chute or guide 36 such as to position its inlet or upper end in communication with coin insertion slot 26 and its lower or outlet end in communication with a coin collection box, not shown. A coin slot blocking or constricting member 38 may be removably fixed in association with the coin chute in order to adjustably control the maximum diameter coin which may be inserted through slot 26. Face plate 18 also serves to carry a bracket 39, which serves to slideably support a locking bolt 40 for reciprocation between the contracted-unlocked position shown in FIG. 2 and an extended-locked position, not shown, in which it is disposed in locking association with door 12.

Again referring to FIG. 2, it will be understood that patron lock 22 includes a cylindrical housing, not shown, which is non-movably carried by face plate 18; a cup-shaped barrel 42, which is rotatably supported on the patron lock housing; and a lock cylinder, not shown, which is rotatably supported within the patron lock housing so as to permit rotation thereof under the control of a patron's key, also not shown. An end portion 43, which is connected to the rear of the patron lock cylinder, extends through the rear end of the cylindrical housing for driving connection with barrel 42. A disc 44 is fixed to the forward end of barrel 42 and provided with an arm, not shown, for connecting the barrel to lock bolt 40, such that the lock bolt is moved to an extended-locking position upon rotation of the barrel in a counter-clockwise direction, as viewed in FIGS. 2 and 3. A disc 46, which is also carried on the forward end of barrel 42, is notched to provide a shoulder 48 adapted to cooperate with a pawl 50, which is in turn pivotally supported by a pin shaft 52. A spring 54 serves to normally bias pivot pawl 50 radially into contact with disc 46 for engagement with shoulder 48. When barrel 42 is in its normal unlocked position shown in FIG. 2, a high-peripheral portion of disc 46 engages with pawl 50, so as to position the latter radially outwardly of shoulder 48. When barrel 42 is rotated in a counter-clockwise direction, as viewed in FIG. 2, spring 54 pivots pawl 50 inwardly, whereupon the shoulder engages the pawl and limits further rotation of the barrel in the absence of a coin being positioned within coin guide 36 by an intercepting finger 60, which is located relatively adjacent the lower or outlet end of the coin chute. Finger 60 is carried by a lever 62 pivotally mounted on the coin chute by pivot pin 64. When a coin is properly positioned by intercepting finger 60, a coin feeler mechanism 66 associated with pawl 50 serves to hold the latter in a position radially outwardly of shoulder 48, so as to permit the shoulder to move past the pawl, as barrel 42 is rotated into its locked position shown only in FIG. 3.

It will be understood that lever 62 preferably carries an adjustably mounted, forwardly projecting finger or cam follower 68, which is normally maintained under the influence of gravity in engagement with the rearwardly facing surface of a bracket 70 carried by barrel 42. This surface is provided with a forwardly sloping or inclined arcuate cam surface 72, which is placed in alignment with cam follower 68 each time the patron lock is rotated into its locked position, whereby to permit the cam follower to move forwardly under the influence of gravity in order to remove coin intercepter finger 60 from engagement with the coin which it had previously retained in position within the coin chute and permit such coin to pass downwardly towards the coin collection box. After the coin is released, barrel 42 may be returned to its unlocked position, but can not again be rotated into locked condition until a subsequently inserted coin is sensed by mechanism 66.

Figure 3:
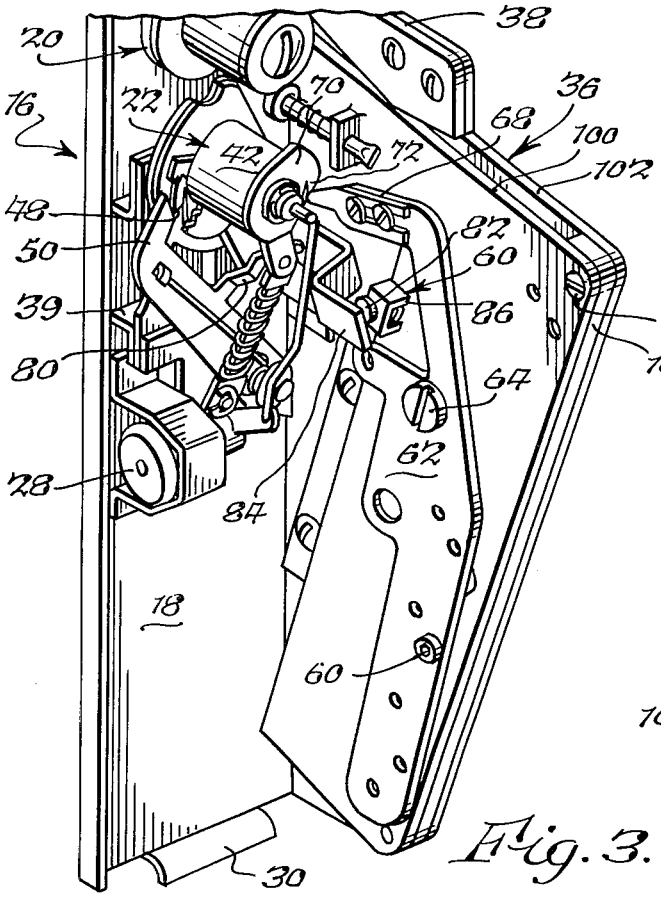
FIG. 3 is a perspective view similar to FIG. 2, but showing the lock unit in cabinet door locked condition.

Patron lock barrel 42 is also connected to counter 28, as by a driving or connecting rod 74, such that the counter is stepped once during each full operational cycle of the patron lock barrel between its normal unlocked position shown in FIG. 2 and its locked position shown in FIG. 3.

Patron lock release rod 24 serves to constrain locking rotation of the patron lock, until it is forced rearwardly from locking engagement within a notch 76 formed in disc 44 by movement of door 12 into fully closed position.

As thus far described, locking unit 16 is quite similar in structure and mode of operation to units described in above mentioned U.S. Pat. Nos. 3,228,506 and 3,509,770. In these prior units, however, coin feeler mechanism 66 simply comprises a feeler finger 80, which is formed integrally with pawl 50 and directly insertable through a side wall opening, not shown, arranged relatively adjacent the upper or inlet end of the coin chute in order to sense the presence of a single coin supported within such coin chute by finger 60. In the present construction, the configuration of coin chute 36 to be hereinafter described, requires that the chute be set back from the front of the locking unit such that it is necessary to form feeler mechanism 66 with a feeler plunger 82, which is coupled with feeler finger 80 by means of a bracket 84 hingedly supported for free vertical swinging movements about an axis arranged essentially perpendicular to face plate 18. Feeler plunger 82 is supported by a coin chute mounted bracket 86 for reciprocating movement into and out of coin chute side opening 90, shown only in FIG. 4, under the control of a coil spring 92. Coil spring 92 normally serves to retain plunger 82 in an outer or non-feeling position, but is deformable to permit inward coin feeling movement of the plunger whenever finger 80 is forced into engagement with bracket 84.

The present invention is adapted for use in providing a multiple coin-multiple denomination capacity for conventional single coin-single denomination operated locks of the type thus far described. For purposes of illustration, specific reference will be made to a coin operated lock intended to employ English currency having useful coin denominations of for instance 5, 10 and 50 Pence. It will be understood, however, that the present invention is not limited to its use with any given currency, so long as such currency is characterized in that the coin size or diameter of each denomination is essentially constant and the coin sizes or diameters vary by a given or known amount from denomination to denomination.

Figure 4:
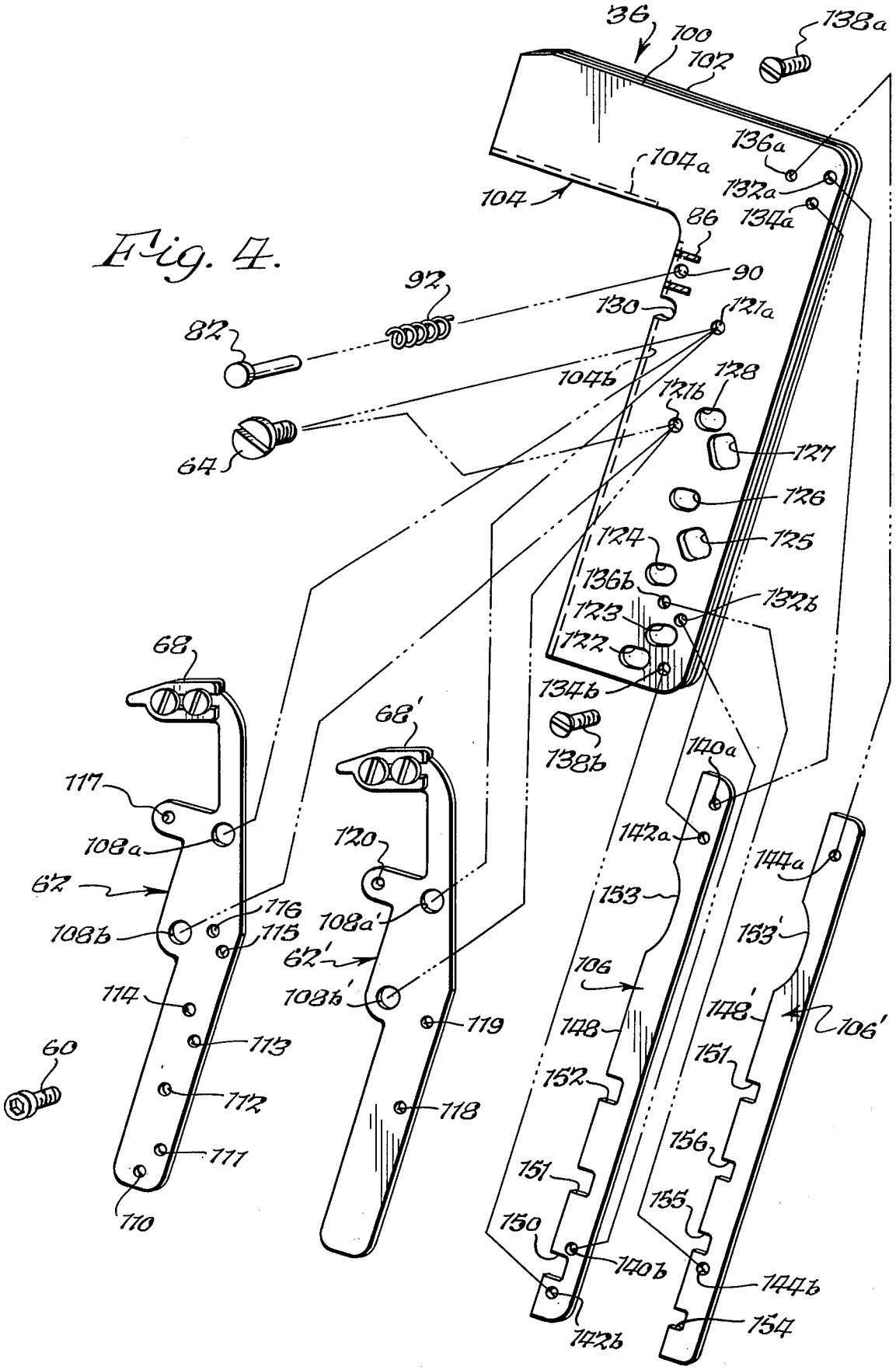
FIG. 4 is an exploded view illustrating the mode of modifying or adjusting the coin chute and coin sensing finger to accommodate various sizes and numbers of coins.

Now referring particularly to FIG. 4, it will be understood that the preferred form of the present invention includes a lever 62', which is interchangably mounted with lever 62 on chute 36; and a novelly designed coin chute construction including permanently mounted vertically disposed and essentially parallel side plates 100 and 102, which have their forward edges interconnected by a front guide 104, and a pair of interchangeably mounted spacer bars 106 and 106'. The spacing between side plates 100 and 102 will be sufficient to accommodate the maximum thickness of the coin to be used for operating the lock, while at the same time insuring that the coins "sit on edge" one on top of each other or move edge first within the coin chute. For most currencies the difference in thickness between coins of different denominations will be sufficiently small to avoid the necessity of adjusting the spacing between the side plates.

Levers 62 and 62' are of similar construction in that they are formed with pairs of openings **108*a*, 108*b* and 108*a'*, 108*b'* for alternately receiving pivot pin 64; and threaded openings 110–117 and 118–120, respectively, for alternately and removably receiving intercepting finger 60. The placement of pivot pin 64 and finger 60** will vary depending on the number and size of coins intended to be employed for operating the lock.

Also by reference to FIG. 4, it will be seen that side plate 100 is formed with a pair of threaded openings **121*a* and 121*b* adapted to alternatively receive pivot pin 64; a plurality of clearance openings 122–130 adapted to freely and alternatively receive intercepter finger 60 depending on its positioning on levers 62 and 62'; and three pairs of openings 132*a*–132*b*, 134*a*–134*b* and 136*a*–136*b* for alternatively receiving a pair of mounting screws 138*a*–138*b* by which spacer bars 106 and 106'** are interchangeably mounted on the coin chute.

Front guide 104 includes a ramp portion **104*a*, which extends downwardly and rearwardly from coin slot opening 26 and a chute or guide portion 104*b*, which extends downwardly and forwardly from adjacent the rear end of ramp portion 104*a***.

Spacer bar 106 is provided with two pairs of threaded openings **140*a*–140*b* and 142*a*–142*b*, which are adapted to be aligned with plate openings 132*a*–132*b* and 134*a*–134*b*, respectively, whereas spacer bar 106' is formed with a single pair of threaded openings 144*a*–144*b*, which are adapted to be aligned with plate openings 136*a*–136*b*. Further, spacer bar 106 is formed with a coin supporting edge 148 through which open clearance slots 150–152 are adapted to be aligned with plate clearance openings 123, 125 and 127, respectively, and a coin receiving recess or cutout 153, whereas spacer bar 106' is formed with a coin supporting edge 148' through which open clearance slots 154–157 are adapted to be aligned with plate clearance slots 122, 124, 126 and 128, respectively, and a coin receiving recess or cutout 153'**.

For purpose of reference, lever 62 is used for denomination of 5 and 10 Pence, wherein pivot pin 64 is passed through openings 108*a* and 121*a* for cases where the lock is to be operated by any of two 5 Pence, three 5 Pence, two 10 Pence, three 10 Pence or three 5 Pence and the pivot pin is passed through openings 108*b* and 121*b* for cases where the lock is to be operated by any of one 5 Pence, four 5 Pence, five 5 Pence, four 10 c8 Pence or one 10 Pence. On the other hand, lever 62' is used only for 50 Pence coins, wherein pivot pin 64 is passed through openings 108*a'* and 121*a* when the lock is to be operated by either two 50 Pence or three 50 Pence and through openings 108*b'* and 121*b* only when the lock is to be operated by one 50 Pence.

Further, spacer bar 106 is used to accommodate the lock to receive both 10 and 50 Pence coins, wherein screws 138*a* and 138*b* are passed through aligned openings 132*a*, 140*a* and 132*b*, 140*b* when the lock is to be used with 10 Pence coins, and are passed through aligned openings 134, 142*a* and 134*b*, 142*b*, when the lock is to be operated by 50 Pence coins. Spacer bar 106' is to be used only for 5 Pence coins, in which case screws 138*a* and 138*b* are passed through aligned openings 136*a*, 144*a* and 136*b*, 144*b*, respectively. While the several elements of the present construction are shown at slightly reduced size in the drawings, their shapes and the locations of their openings etc. are believed essentially accurate within drawing tolerances.

Figure 5:
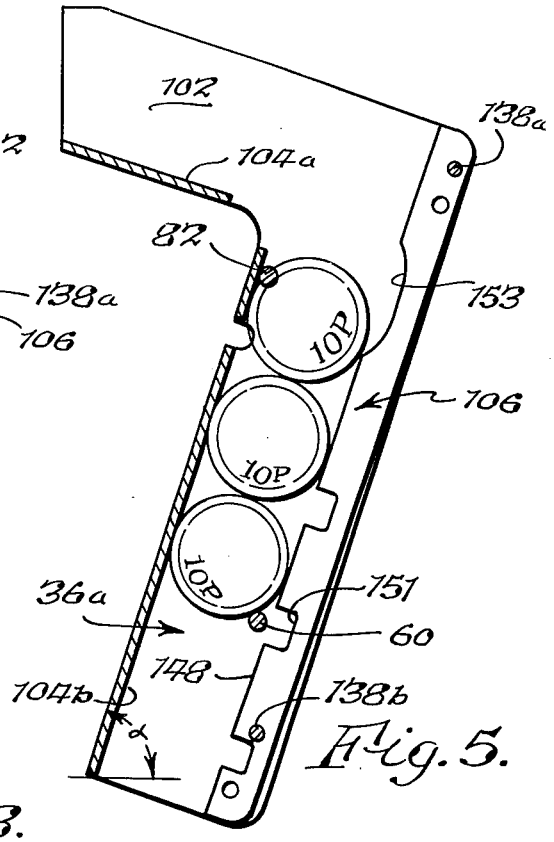
FIG. 5 is a fragmentary view of a coin chute adjusted to accommodate three coins of a given denomination, wherein such coins are shown as being positioned within the chute.

It will be understood that in all forms of the present invention, coin edge supporting surfaces 148 and 148' face upwardly and are disposed essentially parallel to the permanent guide portion 104*b* and are spaced therefrom through a distance essentially equal to, but slightly in excess of the diameter of the particular coin denomination intended to be employed in operating the lock, so as to permit free downwardly movement thereof with the chute. Also, as indicated in FIG. 5, coin holding-sensing portion 36*a* of chute 36 will be inclined or sloped at an angle $\alpha$ relative to the horizontal in order to insure proper gravity feed of coins downwardly therethrough, while at the same time insuring proper positioning or referencing of coins within the coin slot. It is critical that the angle $\alpha$ should be sufficiently small and that the spacing between surfaces 104*b* and 148 should correspond to that mentioned above in order to prevent a second or other subsequently deposited coin from moving away from supporting engagement with edge surfaces 148 or 148' by rolling over a previously inserted coin of the given currency in a direction towards front guide 104*b*. At the same time, it is undesirable to substantially reduce the value of $\alpha$ below that indicated in the drawings, since this would necessitate an undesirable increase in the depth of the lock measured rearwardly of plate 18.

For the illustrated lock design and currency disclosed, the value of the angle $\alpha$ would preferably be equal to or less than about 65°. As the difference in diameters of coins of a given currency, which may be used in the lock increases, the value of $\alpha$ will decrease.

The relative placement and spacing between intercepting finger 60 and feeler 92, which is preferably located immediately adjacent surface 104*b*, may be established by trial and error once the denomination and number of coins required to operate the lock has been decided upon. In that the second and all subsequently deposited coins of a multiple coin grouping are constrained by the geometry of coin chute portion 36*a* to rest against surface 148 (or 148'), there will be many instances wherein coins of an improper grouping will not block opening 90, even if recess 153 were not provided. However, the provision of recess 153 is necessary to accommodate the lock to handle without error or malfunction all possible improper multiple coin groupings, as will hereinafter become apparent.

By again referring to FIG. 5, it will be seen that coin receiving recess 153 is arranged opposite to and thus faces feeler finger 82; the latter being disposed immediately adjacent guide 104*b*. Also, it will be appreciated that the location of the lower end of coin receiving recesses 153 and 153' of the spacer bars must not be below that point at which the uppermost coin of a proper group of coins, ie. a given number of coins of a given denomination, will move into such receiving recess so as to uncover feeler opening 90 and thereby not be arranged for engagement by the end of feeler 82. On the other hand, the lower end of the coin receiving recess must be sufficiently low to permit the uppermost coin of an improper group of coins, ie. a group of coins having one or more coins of an improper denomination to roll into such receiving recess, if it would otherwise cover the feeler opening. The location of the upper end of the coin receiving recess is not as critical, since it is only necessary that the recess be of sufficient length to accommodate the uppermost coin or coins of an improper group of coins, as the need arises. The exact placement of recesses 153 and 153', as well as the locations of feeler finger 60 and pivot pin 64, relative to the fixed feeler opening 90 will of course be determined by the sizes of the denominations of currency for which the lock construction is designed.

To facilitate understanding of the present invention, specific reference will now be made to FIGS. 2, 3 and 5–7, wherein the several parts are shown as being dimensioned and assembled in order to accommodate the lock unit to operate only after three 10 Pence coins have successively been inserted through coin slot 26, such coins being designated as 10P in FIG. 5. In this form of the invention, lever 62 is employed and mounted on the coin chute by passing pivot pin 64 successively through openings 108*a* and 121*a;* intercepting finger 60 is carried within lever opening 113 to extend through clearance opening 125 into portion 36*a* between side plates 100 and 102; and spacer bar 106 is employed and fixed between side plates by passing screws 138*a* and 138*b* through aligned openings 132*a*, 140*a* and 132*b*, 140*b*, respectively. Also, an appropriately sized blocking member 38 is fixed to the coin chute 36 in order to prevent the introduction of any coin having a diameter in excess of a 10 Pence coin.

With this arrangement, the first 10 Pence coin to be inserted will come to rest against intercepting finger 60 and guide portion 104*b*, whereas the spacing between finger 60 and guide portion 104*b* will permit any previously inserted smaller size coin such as a 2 Pence or 5 Pence coin, to freely pass downwardly out of the coin chute directly to a coin box or to a coin return, as desired. If two more 10 Pence coins are thereafter inserted in succession, they will rest against coin supporting edge 148 and the next proceeding coin, such that the uppermost or third coin of the proper group of three 10 Pence coins will be arranged such that its rim portion just covers opening 90. It will again be noted that the lower end of recess 153 is disposed immediately above that point which would permit the third 10 Pence coin to move or roll into such recess.

Thereafter when the lock is operated in the manner previously described, feeler finger 82 will engage the uppermost coin of the proper group and permit barrel 42 of the patron lock to be rotated into its locked position shown in FIG. 3. Also, as previously indicated, movement of barrel 42 in this manner serves to release or free lever 62 for gravity induced counter-clockwise movement into its coin release position shown in FIG. 3, during which time intercepting finger 60 moves out of chute portion 36*a* into slot 151 to permit the sensed group of coins to pass downwardly to the coin box.

Figure 6:
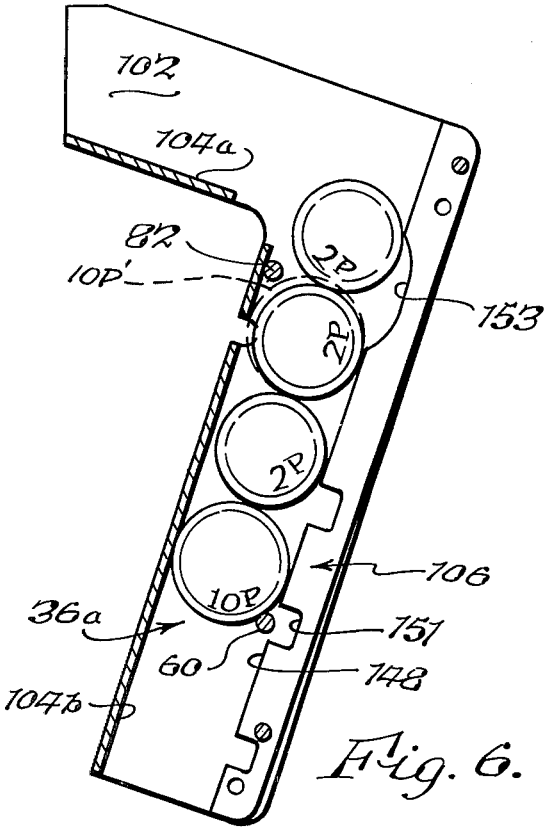
FIGS. 6 and 7 are views similar to FIG. 5, but showing coins of improper denomination inserted in the chute.

For purposes of comparison, reference is now made to FIG. 6, wherein three 2 Pence coins identified as 2P are improperly inserted into the lock after a single 10 Pence coin identified as 10P has been inserted. As in the previous example, the subsequently inserted 2 Pence coins will come to rest in engagement with supporting edge surface 148 and the next proceeding coin, but none of the coins will be arranged to cover opening 90, due to the spacing between finger 60 and feeler 82. The arrangement is such that even if the third coin happens to be a 10 Pence coin, as indicated in broken line as 10P′, rather than a 2 Pence coin, the latter will not serve to cover opening 90. If a fourth coin of any denomination is inserted, such as indicated in FIG. 6 in the case of a 2 Pence coin, this will have no effect on the operation of the lock, since it will either rest on edge 148 or move into recess 153 depending on its size. Thus, the lock may not be operated with this grouping of coins as long as one coin of the inserted group of coins is not of proper denomination, regardless of the sequence in which the proper and improper coin denominations are inserted.

Figure 7:
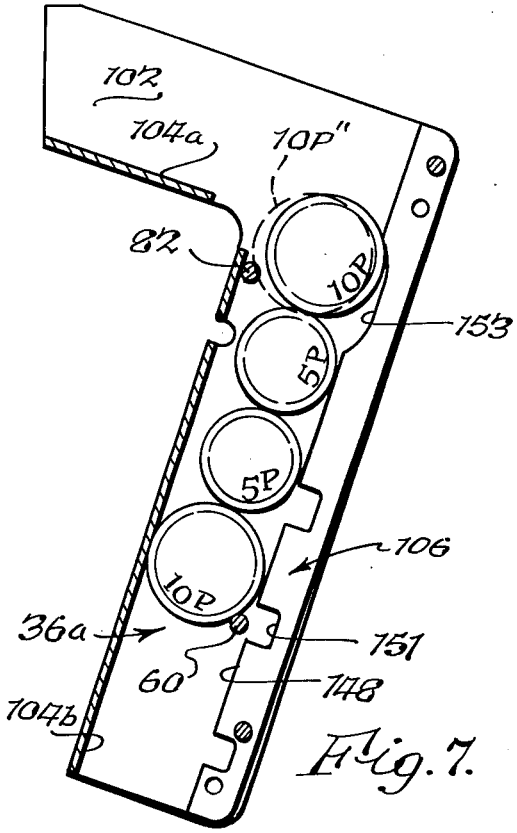

FIG. 7 is now referred to for the purpose of illustrating further possible improper coin groupings or combinations wherein recess 153 is specifically relied upon to prevent opening 90 from being covered by such groups. In solid line there is illustrated an improper group of coins consisting of one 10 Pence coin, two 5 Pence coins and one 10 Pence coin, wherein the last coin identified as 10P is received in recess 153. With this specific coin grouping, the last 10 Pence coin would come to rest in the position shown in broken line as 10 P″ and serve to improperly cover opening 90, if recess 153 were not provided.

As previously indicated, the slope of chute portion 36*a* is such as to prevent a second or other subsequently deposited coin of any size which can be inserted through coin slot 26 from "rolling" over a previously deposited coin of a given currency in a direction towards guide 104*b*. Rather, the slope of chute portion 36*a* and the spacing between surfaces 104*b* and 148 is such as to require coins to "roll" towards surface 148, regardless of their size and the sequence in which they are inserted, and to move into recess 153 whenever they might otherwise be arranged for engagement by feeler pin 82.

Of course whenever a group of improperly sized coins have been inserted in chute 36, whether willfully or by mistake, it will thereafter be impossible to operate patron lock 22 until coin chute 36 is cleared by a custodian gaining access to the lock unit by means of custodian lock 20.

While in the preferred construction illustrated in the drawings, portion 36*a* is arranged to slope downwardly and towards the rear surface of face plate 18, it will be understood that a rearrangement of parts will permit portion 36*a* to slope downwardly and away from face plate 18. Also, the structure could be further modified to permit intercepting finger 60 to cooperate with surface 148 to retain the first deposited properly sized coin in position and move towards front guide 104*b* for the purpose of releasing a group of coins when lever 62 moves into its release position as suggested by the provision of levers 62 and 62′ with openings 117 and 120, respectively.

While a specific embodiment of the present invention has been described with reference to its use with a proper multiple coin grouping consisting of three 10 Pence coins, it is believed apparent that the present construction will perform equally well for groups of other denominations and/or sized groups including 1, 2, 4 or more coins. In this respect, it will be understood that for groupings including 2, 4 or more coins, the manner of operation will be identical to that described with reference to a grouping of three coins. On the other hand, when the "grouping" is to consist of only one coin, the mode of operation would be similar to prior conventional structures from the standpoint that all coins larger than a proper or given size coin would be prevented from being inserted into the coin chute and the intercepting finger would permit any coin having a diameter less than that of the proper coin to freely pass downwardly through the discharge end of the coin chute.

We claim:

1. In a coin operated lock of the type having a coin chute formed with vertically spaced coin inlet and discharge ends and constraining coins to move on edge downwardly therethrough, an intercepting finger arranged relatively adjacent said discharge end for releasably retaining a coin deposited in said chute and a coin feeler arranged relatively adjacent said inlet end and being removably insertable into said chute for sensing the presence of a coin retained therein by said intercepting finger, characterized in that operation of said lock may be effected only upon sensing of the presence of a coin by said coin feeler whereafter the sensed coin is released by said intercepting finger for discharge through said discharge end, the improvement for permitting said lock to be operated by a proper grouping of coins consisting of two or more coins of a given denomination of a given currency successively deposited in said coin chute and setting edge on edge therewithin, which comprises:

said coin chute being vertically bounded by a downwardly facing guide surface and an upwardly facing coin edge supporting surface arranged essentially parallel to said guide surface and spaced therefrom through a distance corresponding essentially to the diameter of the coin of said given denomination while permitting free movement of said coin of said given denomination downwardly through said chute, said surfaces being inclined at an angle to the horizontal affording gravity feed of coins through said chute while preventing a second or subsequently deposited coin from moving away from supporting engagement with said supporting surface by rolling over a previously deposited coin in a direction towards the guide surface, said coin feeler being arranged immediately adjacent said guide surface, said supporting surface having a coin receiving recess opening therethrough in a facing relationship with said coin feeler, said intercepting finger cooperating with one of said guide and supporting surfaces to releasably retain a first deposited coin of said given denomination within said coin chute while permitting previously deposited coins of other denominations of said given currency having a diameter less than said diameter to freely pass downwardly through said discharge end, said intercepting finger being spaced from said coin feeler through a distance insuring the positioning of a portion of a last deposited coin of said proper grouping for sensing by said coin feeler, said coin receiving recess having a lower end thereof arranged immediately above a point along said supporting surface at which said last deposited coin would be unsupported by said supporting surface and move into said coin receiving recess and away from a position thereof in which it can be sensed by said coin feeler, characterized in that the positioning of said intercepting finger relative to said coin feeler and the presence of said coin receiving recess prevents sensing of any coin by said coin feeler when a second or subsequently deposited coin of said given currency includes a coin of a denomination other than said given denomination.

2. In a coin operated lock of the type having a coin slot through which coins are inserted into the lock, a coin chute, said coin chute being formed with vertically spaced coin inlet and discharge ends and constraining coins to move on edge downwardly therethrough, said inlet end communicating with said coin slot, an intercepting finger arranged relatively adjacent said discharge end for releasably retaining coins deposited in said chute and a coin feeler arranged relatively adjacent said inlet end and removably insertable into said chute for sensing the presence of a coin retained therein by said intercepting finger, characterized in that said lock may be moved from an unlocked into a locked condition only upon sensing of the presence of a coin by said coin feeler whereafter said intercepting finger is moved to release the sensed coin for discharge through said discharge end, the improvement for permitting said lock to be operated by a proper grouping of coins consisting of two or more coins of a given denomination of a given currency successively deposited in said coin chute and sitting edge on edge therewith, which comprises:

said coin chute comprising a pair of vertically extending side plates, a front plate and a spacer bar, said front plate extending between said side plates and having a ramp portion extending downwardly and rearwardly from adjacent said coin slot and a guide portion extending downwardly and forwardly from adjacent a rear end of said ramp portion to define a downwardly and rearwardly facing guide surface, said spacer bar being supported to extend between said side plates and defining an upwardly and forwardly facing coin edge supported surface arranged to face and be essentially parallel to said guide surface, said supporting surface being spaced from said guide surface through a distance corresponding essentially to the diameter of a coin of said given denomination while permitting free movement of said coin of said given denomination downwardly through said chute, said guide and supporting surfaces being inclined at an angle to the horizontal affording gravity feed of coins through said chute while preventing a second or subsequently deposited coin from moving away from supporting engagement with said supporting surface by rolling over a previously deposited coin in a direction towards said guide surface, said spacer bar having a coin receiving recess opening through said supporting surface, and one of said side plates having at least one clearance opening, at least one pivot pin supporting opening and an opening to freely receive said coin feeler to extend into said coin chute immediately adjacent said guide surface; and a lever pivotally supported on a pivot pin received in said pivot opening and arranged adjacent said one side plate outwardly of said coin chute, said lever having at least one opening for supporting said intercepting finger to extend through said clearance opening into said coin chute, said lever being normally maintained by said lock when in unlocked condition to position said intercepting finger for cooperation with one of said guide and supporting surfaces to support a first deposited coin of said given denomination within said coin chute while permitting previously deposited coins of other denominations of said currency having a diameter less than the diameter than said coin of said given denomination to pass downwardly through said discharge end, the other of said guide and supporting surfaces having a slot opening therethrough, said lever being movable in response to movement of said lock into said locked condition to remove said intercepting finger from within said coin chute for positioning within said slot thereby to permit passage of all coins within said coin chute downwardly through said discharge end, said intercepting finger when said lock is in said unlocked condition being spaced from said coin feeler through a distance insuring the positioning of a last deposited coin of said proper grouping for sensing by said coin feeler, said coin receiving recess having a lower end thereof arranged immediately above a point along said supporting surface at which said last deposited coin would be unsupported by said supporting surface and moved into said recess and away from a position thereof in which it can be sensed by said coin feeler, characterized in that positioning of said intercepting finger relative to said coin feeler and the presence of said coin receiving recess prevents sensing of any coin by said coin feeler when a second or subsequently deposited coin of said given currency is of a denominatin other than said given denomination.

* * * * *